US006499904B2

(12) United States Patent
Nye

(10) Patent No.: US 6,499,904 B2
(45) Date of Patent: Dec. 31, 2002

(54) EXCAVATOR COUPLER USING FLUID OPERATED ACTUATOR

(75) Inventor: John Charles Nye, Mississauga (CA)

(73) Assignee: Nye Manufacturing Ltd. (CA)

( * ) Notice: Subject to any disclaimer, the term of this patent is extended or adjusted under 35 U.S.C. 154(b) by 68 days.

(21) Appl. No.: 09/766,191

(22) Filed: Jan. 19, 2001

(65) Prior Publication Data

US 2002/0098032 A1 Jul. 25, 2002

(51) Int. Cl.[7] ..... F16B 1/00
(52) U.S. Cl. ..... 403/31; 414/723; 37/468
(58) Field of Search ..... 403/31; 414/723, 414/724; 172/272; 37/231, 403, 443, 444, 466, 468

(56) References Cited

U.S. PATENT DOCUMENTS

| | | | | | |
|---|---|---|---|---|---|
| 3,039,209 | A | * | 6/1962 | Cron et al. | 414/723 |
| 3,269,570 | A | | 8/1966 | Wallberg | |
| 3,705,656 | A | | 12/1972 | Hunger et al. | |
| 3,874,533 | A | | 4/1975 | Montgomery | |
| 4,265,587 | A | | 5/1981 | Clark | |
| 4,586,867 | A | | 5/1986 | Stafford | |
| 4,643,631 | A | | 2/1987 | Maurer et al. | |
| 4,836,741 | A | | 6/1989 | St. Louis et al. | |
| 4,930,974 | A | * | 6/1990 | Langenfeld et al. | 414/723 |
| 4,948,328 | A | * | 8/1990 | Busch | 414/723 |
| 4,986,722 | A | | 1/1991 | Kaczmarczyk et al. | |
| 5,010,962 | A | | 4/1991 | Bloom, Jr. | |
| 5,024,010 | A | | 6/1991 | Hulden | |
| 5,044,448 | A | | 9/1991 | Lynch et al. | |
| 5,310,275 | A | | 5/1994 | Lovitt | |
| 5,360,313 | A | | 11/1994 | Gilmore, Jr. et al. | |
| 5,394,630 | A | * | 3/1995 | Moinat | 37/468 |
| 5,403,144 | A | * | 4/1995 | Staben, Jr. | 414/723 |
| 5,456,030 | A | | 10/1995 | Bourne et al. | |
| 5,581,917 | A | | 12/1996 | Barden | |
| 5,611,158 | A | * | 3/1997 | Pratt et al. | 37/468 |
| 5,769,596 | A | | 6/1998 | Burton | |
| 5,915,837 | A | | 6/1999 | Brown et al. | |
| 5,950,735 | A | * | 9/1999 | Godbersen | 37/468 |
| 6,126,216 | A | * | 10/2000 | Tollefson | 37/406 |
| 6,332,747 | B1 | * | 12/2001 | Lee | 414/723 |
| 6,360,459 | B1 | * | 3/2002 | Brookhart et al. | 37/442 |

* cited by examiner

*Primary Examiner*—Lynne H. Browne
*Assistant Examiner*—Kenn Thompson
(74) *Attorney, Agent, or Firm*—Young & Basile, P.C.

(57) ABSTRACT

A quick coupling device for releasably connecting a boom arm to a tool, such as a material handling bucket, including a coupling frame adapted for connection to the boom and having wedge members provided on opposite, vertically extending sides thereof and projecting outwardly in a transverse direction from these sides. The wedge members engage in wedge-shaped channels formed by rigid connecting rails mounted on the top of the bucket. A hydraulic locking mechanism for securing the wedge members in the wedge-shaped channels is mounted at one end of the coupling frame and includes a hydraulic actuator and preferably two locking bars movable by this actuator between a locked position and an unlocked position. During use of this coupling device, in the locking position the two locking bars extend into cooperating openings provided on the connecting rails and thereby prevent the coupling device from detaching from the bucket. The preferred coupling frame includes two parallel connecting plates forming opposite sides of the frame and rigid connecting frame members extending between and joining these connecting plates.

20 Claims, 8 Drawing Sheets

EXCAVATOR COUPLER USING FLUID OPERATED ACTUATOR

BACKGROUND OF THE INVENTION

This invention relates to coupling devices for attaching an implement, such as a large bucket, to a power operated boom of a machine, such as a backhoe or excavator.

It is known to provide excavators, power shovels and backhoes with different sizes and types of material handling implements, such as buckets, to permit various operations. For example, a large bucket may be required for a backhoe to carry out certain types of digging, while a smaller bucket may be more appropriate for another digging job. Changing from one bucket or implement to another can be a problem because of the time and labor expended in the changeover and the difficulties that can be encountered. A backhoe bucket or a shovel implement can be very heavy and awkward to manipulate to the required position. Devices that permit the quick and relatively easy detachment of an existing bucket from the power operated boom and that permit a new bucket to be attached relatively easily and quickly are now desired by the earth handling industry, including contractors and operators of earth handling equipment.

A number of mechanisms have been developed previously in an effort to provide a mechanism that can quickly connect to an excavator bucket and then disconnect later, when required.

U.S. Pat. No. 5,310,275 issued May 10, 1994 to E. L. Lovitt discloses a quick coupler for heavy equipment implements. A pair of hydraulic pistons are used to secure a shovel to a boom arm of a heavy vehicle. The shovel and the boom arm have a set of "V" shaped guides which come into contact to allow the shovel to be pivoted into position. The shovel also has two horizontally extending members which fit into two slots in the arm and allow the pistons with their movable shafts to engage them in order to secure the shovel.

U.S. Pat. No. 4,586,867 issued May 6, 1986 to R. Stafford also discloses a quick coupler which utilizes a pair of hydraulic cylinders attached to movable bolts to engage a bucket to a boom arm of a heavy vehicle. This specification also teaches the use of a cylindrical bar mated with a curved channel member for support, while the bucket is secured to the boom arm by the locking bolts connected to the hydraulic cylinders, these bolts extending through holes in plates attached to the bucket.

U.S. Pat. No. 5,915,837 issued Jun. 29, 1999 to Caterpillar Inc. teaches a quick coupling apparatus that incorporates the use of a piston controlled securing bar and curved hook shaped member for engaging and rotating about a cylindrical member attached to a boom arm of a heavy machine. This patent also discloses the use of a mated pair of curved members for the transport of force. This apparatus using linkage members that are positioned in a locked position when the power device is attached to the bucket. The linkage members include a latch having a pair of spaced apart ends.

U.S. Pat. No. 5,024,010 issued Jun. 18, 1991 to Fritiof Hulden discloses a quick coupling system that uses hooks to rotatably connect a bucket to a boom arm. A piston is used to engage a securing apparatus to the bucket. This coupling employs a pair of parallel link arms that are pivotably mounted on the boom arm. There is a locking unit held between these arms that has a slidable tension pin that engages a wedge support affixed to the bucket.

It is an object of the present invention to provide a quick coupling apparatus for attaching an implement such as a bucket to a boom wherein the apparatus can be manufactured at a reasonable cost and is relatively easy for a machine operator to use.

It is a further object of the present invention to provide a coupling apparatus that employs wedge shaped connecting members and a hydraulically operated locking device to secure the coupling apparatus in place, therefore providing a rigid, secure connection between the material handling implement, such as a bucket, and a power operated boom to which the bucket is attached.

SUMMARY OF THE INVENTION

According to one aspect of the invention, a coupling device for releasably connecting a boom arm to a tool, such as a material handling bucket, comprises a coupling frame adapted for connection to the boom and having wedge members provided on opposite, vertically extending sides thereof and projecting outwardly and in a transverse direction from the vertically extending sides. These wedge members are adapted to engage in wedge shaped channels formed by connecting members mounted on the tool. There is also a fluid actuated mechanism for securing the wedge members in the wedge-shaped channels. This locking mechanism is mounted on the coupling frame and includes a fluid actuator, at least one locking bar movable by the fluid actuator between a locking position and an unlocked position, and a track rigidly connected to the coupling frame. The track is for guiding movement of the at least one locking bar. In particular, the at least one locking bar is slidable along the track between the locking position and the unlocked position. During use of this coupling device, in the locking position, the at least one locking bar extends into a cooperating opening provided on the tool and thereby prevents the coupling device from detaching from the tool.

The preferred coupling frame comprises two, parallel connecting plates forming opposite sides of the coupling frame and rigid connecting frame members extending between and joining the connecting plates. The connecting plates both have pin-receiving apertures for pivotably connecting the coupling device to the boom arm by means of one or more connecting pins.

The preferred fluid actuator includes a double acting hydraulic cylinder having two piston rods extending from two opposite ends of the cylinder.

According to another aspect of the invention, a combination of a tool attachment and a coupling device for releasably coupling the tool attachment to a boom arm is provided. The tool attachment includes two spaced-apart connecting members arranged on a side of the tool attachment and each of these connecting members forms a wedge-shaped channel which is open at one end thereof. The coupling device comprises a coupling frame adapted for connection to the boom and having wedging devices provided on opposite sides thereof. Each wedging device is adapted to slide into a respective one of the wedge-shaped channels by means of the open end of the channel and to engage a respective one of the connecting members. A locking mechanism for securing the wedging devices in the wedge-shaped channels includes a fluid actuator and at least one locking bar movable by the fluid actuator between a locking position and an unlocked position. When the coupling device is attached to the tool attachment, the at least one locking bar extends into a bar receiving opening formed on the side of the tool attachment and thereby prevents the coupling device from detaching from the tool attachment.

In the preferred combination, the connecting members are parallel metal rail members and each wedge-shaped channel is formed on an inner side of its respective rail member so that the two wedge-shaped channels face one another.

According to still another aspect of this invention, a coupling device for releasably connecting a movable arm to a tool includes a coupling frame pivotably attachable to the movable arm, this frame including a pair of spaced-apart mounting plates each having a pair of pin-receiving holes with the holes of one mounting plate being aligned with the corresponding holes of the other mounting plate. Two wedge members are rigidly mounted on outer surfaces of the mounting plates with each of the wedge members mounted on a respective one of the mounting plates and projecting from a side thereof furthest from the other mounting plate. The wedge members are adapted for insertion in connecting channels provided on a side of the tool. A locking mechanism is provided as well to secure the wedge members in the channels, this mechanism including a fluid operated actuator attached to the coupling frame and at least one locking member slidable along a guide provided on the coupling frame between a locking position and an unlocked position. During use of this coupling device, the at least one locking member can be extended into a cooperating opening provided on the tool by the fluid operated actuator in order to prevent the coupling device from separating from the tool.

Further features and advantages will become apparent from the following detailed description of a preferred embodiment taken in conjunction with the accompanying drawings.

DETAILED DESCRIPTION OF PREFERRED EMBODIMENT

Figure 7:
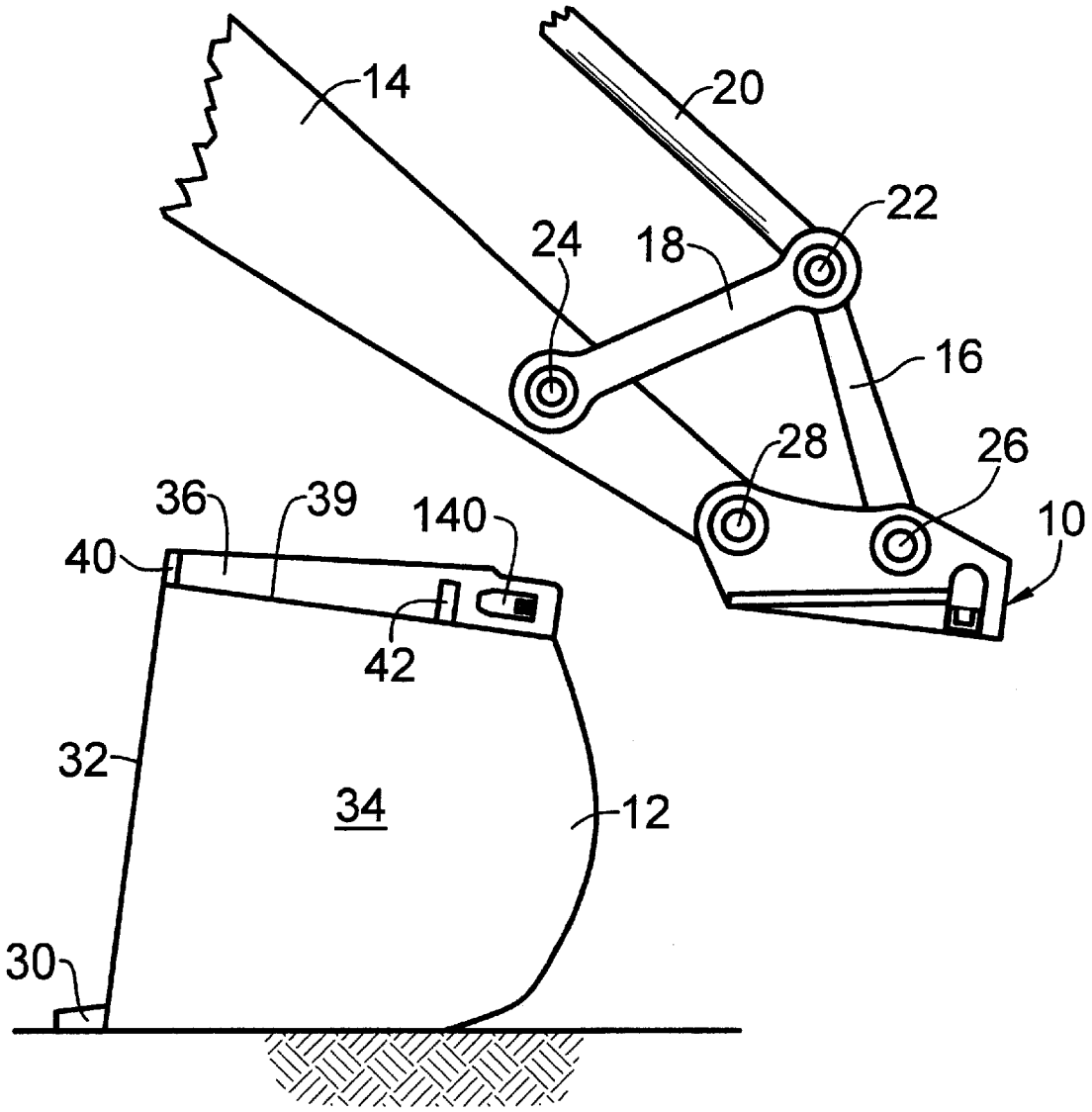
FIG. 7 is a side elevation illustrating a backhoe bucket fitted with the mounting rails of FIGS. 4 to 6 and a quick coupler of the invention pivotably mounted on a lower end section of a power operated boom of a backhoe machine.

With initial reference to FIG. 7 of the drawings, the present invention is directed to a coupling device generally indicated at 10 for attaching a material handling implement or tool, such as a bucket 12, to a power operated boom 14 of a machine such as a backhoe or excavator. In the following description, it will be understood that the same parts are marked throughout the specification and drawings with the same reference numerals. The power operated boom can, for example, be the so called dipper stick of a backhoe, only a portion of which is shown. The backhoe can be a self-propelled vehicle or it could be mounted on a vehicle such as a tractor. For controlling operational movement of the bucket 12 there can be provided the usual links 16 and 18 which are pivotably connected at their ends and which are actuated through a piston 20 that is part of a standard hydraulic cylinder (not shown). Securing the ends of the links 18 are transverse hinge pins 22 and 24. The bottom ends of the links 16 are attached to the apparatus 10 at its forward end by a transverse hinge pin 26 while the bottom end of the dipper stick 14 is pivotably connected to the coupling device 10 by a hinge pin 28. It will be understood that, by securing these components in this relationship using these hinge pins, the coupling device 10 can be pivoted about the hinge pin 28 by means of extension and retraction of the piston 20.

The illustrated material handling bucket 12 can be fitted with standard claw teeth 30 and it has the usual opening at 32 that extends between two spaced apart side walls 34, only one of which is shown in FIG. 7. Mounted on an upper side of the bucket are two spaced-apart, elongate connecting members or rails 36, 38 which can be welded to the upper side of the bucket 12, this upper side being closed by means of a top wall or top plate at 39. One version of the two connecting members 36 and 38 can be seen in FIGS. 4 to 6 and two versions of these two members will be described further hereinafter. If desired, each of these connecting members 36, 38 can be braced and supported by outwardly projecting support brackets 40 and 42 that are shown in FIG. 7. These connecting members are made of a suitably strong material such as relatively thick steel.

Figure 1:
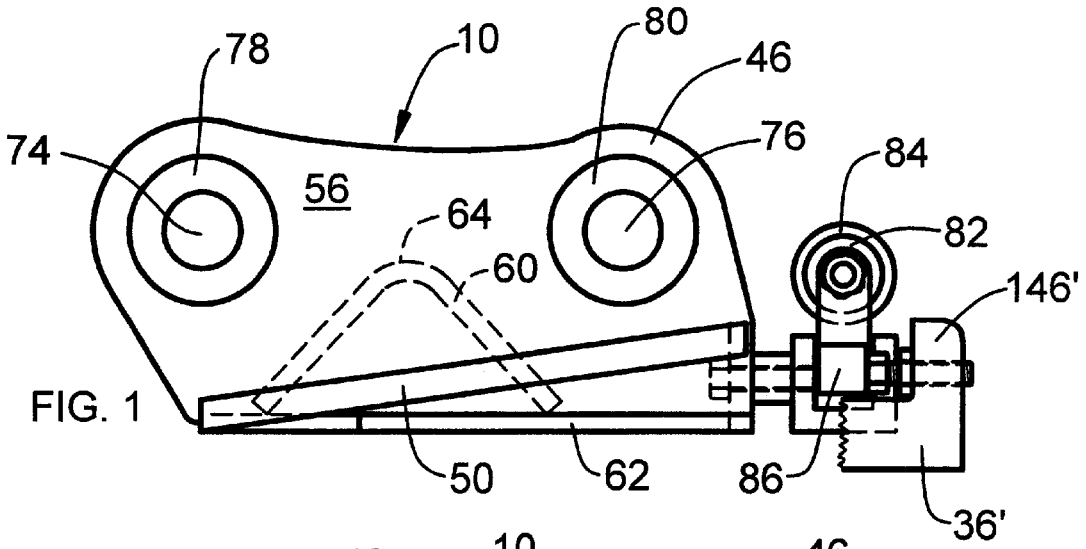
FIG. 1 is a side view of a quick coupler constructed in accordance with the invention, this side view showing only a portion of one of the connecting rails attached to the top of the backhoe bucket (not shown)
Figure 2:
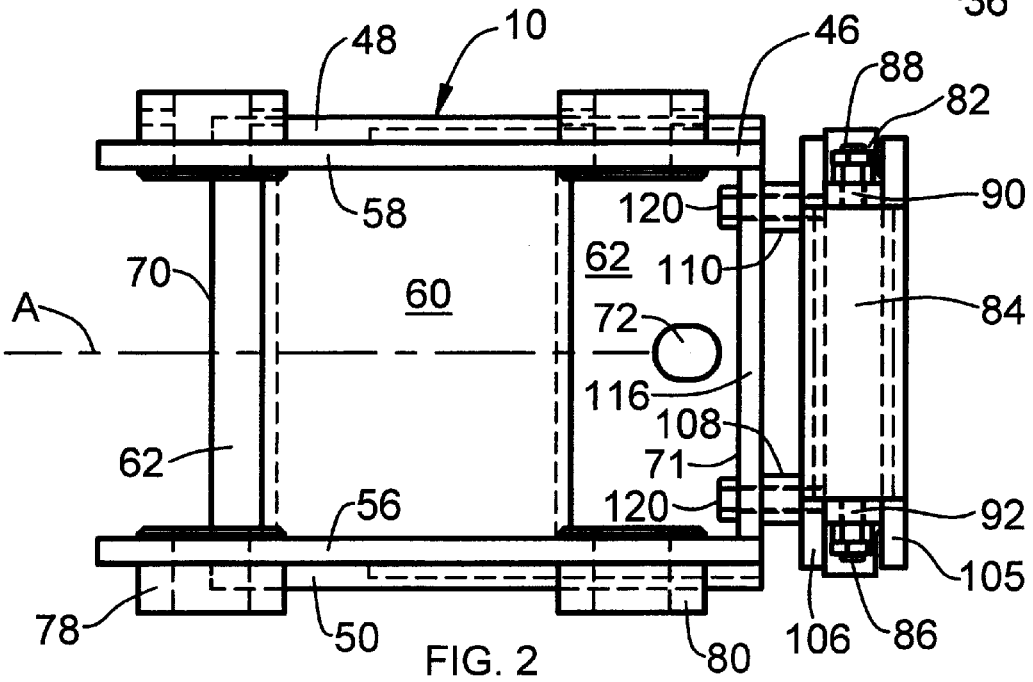
FIG. 2 is a top view of the quick coupler (not including the connecting rails on the bucket) and its hydraulic locking mechanism.
Figure 3:
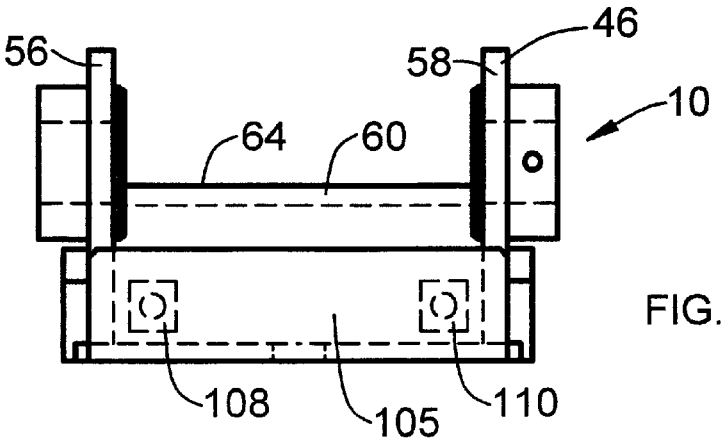
FIG. 3 is an end view of the quick coupler of FIG. 1, this view omitting the hydraulic actuator for the locking mechanism.

With reference now to FIGS. 1 to 3 of the drawings, which illustrate the preferred coupling device of the invention, this coupling device includes a coupling frame 46 adapted for connection to the boom 14 and having wedge members 48, 50 provided on opposite, vertically extending sides thereof. These wedge members project outwardly and in a transverse direction relative to the longitudinal axis of the coupling frame indicated at A from the vertically extending sides. As explained further hereinafter, these wedge members are adapted to engage in wedge-shaped channels 52, 54 formed by the connecting members 36, 38. In one embodiment, the wedge members are 1.25 inches square in cross-section and about 23 inches long.

The illustrated preferred coupling frame comprises two, parallel connecting plates 56, 58 forming opposite sides of the coupling frame. In one preferred embodiment the plates 56, 58 are made from 1.25 inch steel plate. There are also rigid connecting frame members including members 60, 62 extending between and joining the connecting plates 56, 58. The connecting frame member 60 is a bent steel plate having a central, rounded peek at 64. The connecting frame member 62 is a flat plate extending from the rear edge 70 to a front edge at 71. An optional hole 72 can be formed in the plate 62, if desired. The plates 56 and 58 can have rounded contours along their upper edges as shown in FIG. 1. Also, the connecting plates both have pin-receiving apertures 74, 76 for pivotably connecting the coupling device 10 to the boom arm 14 by means of the connecting pins 26, 28 shown in FIG. 7. The two openings 74 and the two openings 76 are respectively aligned in the transverse direction. Preferably bosses 78, 80 are formed around one or both ends of the openings 74, 76 in order to strengthen the plate members around these openings.

The coupling device of the present invention also includes a fluid actuated locking mechanism indicated generally at 82 for securing the wedge members 48, 50 in the wedge-shaped channels 52, 54. The locking mechanism is mounted on the coupling frame as illustrated in FIGS. 1 and 2 and it includes a fluid actuator 84 and at least one locking bar movable by the fluid actuator between a locking position and an unlocked position.

Figure 9:
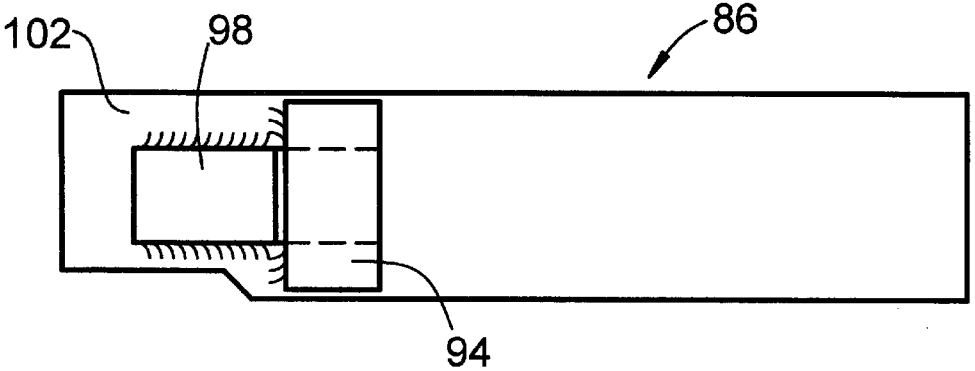
FIG. 9 is a detail plan view of one locking bar and a connecting lug mounted thereto.
Figure 10:
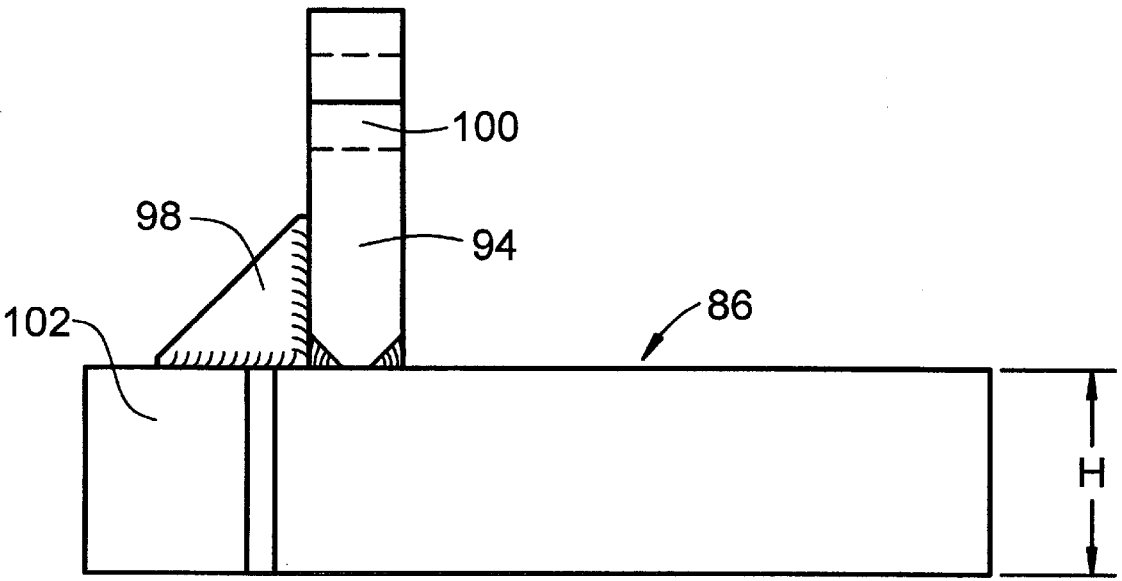
FIG. 10 is an elevational view of the locking bar of FIG. 9.
Figure 11:
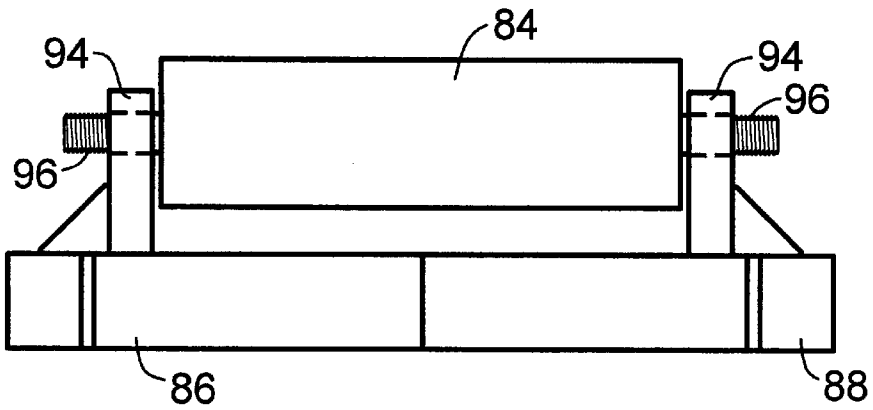
FIG. 11 is a detail front view of a double acting hydraulic cylinder connected to two of the locking bars of FIGS. 9 and 10.

In the preferred embodiment, there are two locking bars 86, 88, the construction of which can be seen in detail in FIGS. 9 to 11. The preferred fluid actuator 84 is a double acting Hydraulic cylinder having two piston rods 90, 92 extending from two opposite ends of the cylinder. The two locking bars are slidable in the transverse direction between the aforementioned locking position and the unlocked position.

With reference to FIGS. 9 to 11 which illustrate the details of the locking bars, the illustrated preferred locking bar has a square cross-section for most of its length and in one embodiment the height and width of the bar is two inches, the height being indicated by H in FIG. 10. The length of each bar can vary but in one embodiment the length is 8¾ inches. Each locking bar is provided with a rigid connecting lug 94 that extends upwardly from the bar and is detachably connected to an outer end of a respective one of the piston rods 90, 92. Each piston rod has a threaded end section at 96 onto which can be threaded a suitable nut. A small triangular brace 98 can be welded to both the bar and its respective lug 94 in order to support the lug. The lug has an aperture at 100 to accommodate the threaded end section 96 of the piston rod. Preferably an end section 102 of each locking bar is machined on one side to reduce the width of this section to 1¾ inches. Since the opening into which the locking bar is extended is adjustable on one vertical side, each locking bar can extend only into the opening and not beyond the opening. The locking bars are preferably heat treated in order to make them strong and less susceptible to breakage.

The locking mechanism 82 includes a fixed track or guide for guiding movement of the two locking bars 86, 88 which are slidable along the track between the locking position and the unlocked position. The illustrated fixed track includes two fixed vertically extending, elongate guide plates 105 and 106 which can extend substantially the width of the coupling frame. The guide plate 106 is connected to a short front plate 116 of the frame by means of two connecting blocks 108, 110 which can be welded or bolted thereto. The connecting blocks 108, 110 can be connected by means of two bolts 120 to the front plate 116 shown in FIG. 2. This front plate extends between and is connected to the main connecting plates 56, 58. A threaded hole 118 can be provided in each of the blocks 108, 110 and this threaded hole can extend into the adjacent guide plate 106, if desired. Two bolt holes are provided in the front plate 116 for the passage of the two connecting bolts 120 which are threaded into the connecting blocks. The guide plates 105, 106 can be connected to one another by means of top and bottom, elongate connecting plates that are located above and below the locking bars. The top connecting plate 112 can be seen in FIG. 8 as can the bottom connecting plate 114.

Figure 4:
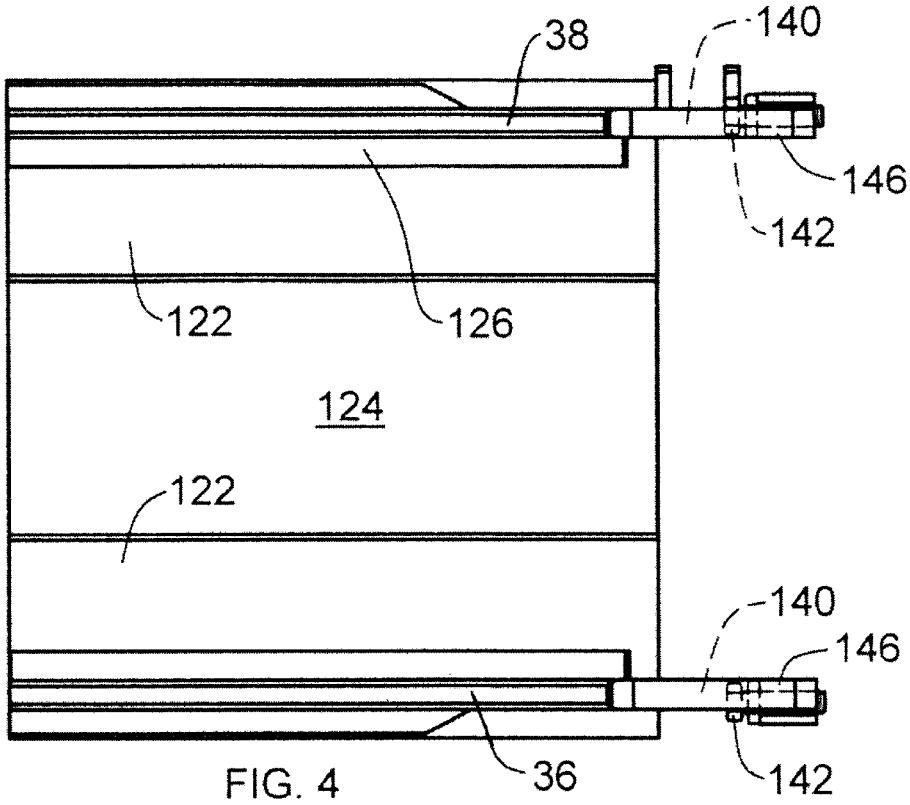
FIG. 4 is a plan view of two mounting rails that in use are rigidly connected to the top of the bucket of the backhoe.
Figure 5:
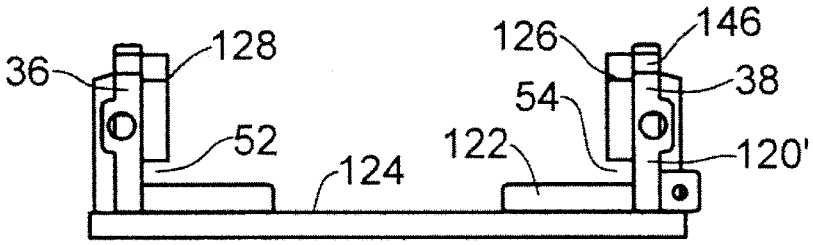
FIG. 5 is an end view of the mounting rails of FIG. 4.
Figure 6:
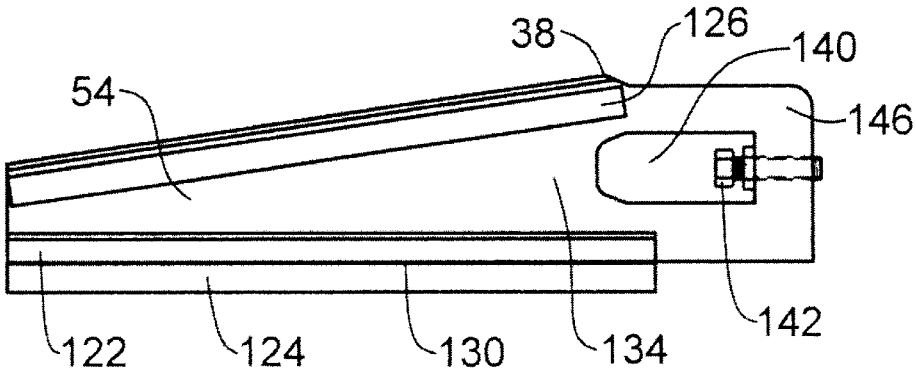
FIG. 6 is an inner side view of one of the mounting rails of FIG. 4.

A preferred version of the connecting members 36, 38 will now be described in more detail with reference to FIGS. 4 to 6 and 8. Each of these connecting members or rails can be made from a strong, steel angle member having a vertically extending side wall 120 and a horizontal, inwardly extending leg 122. If desired, the two connecting members 36, 38 can be rigidly mounted on a rectangular support plate 124 as shown in FIGS. 4 to 6 or these connecting rails can be welded directly to the top plate of the bucket if the top plate is suitable for this purpose.

An elongate wedge member 126, 128 is rigidly connected such as by welding to the inner surface of each connecting member 36, 38. This wedge member extends at a small acute angle to the bottom edge 130 of the respective connecting member as can be seen clearly in FIG. 6. It will be appreciated that the above described cooperating wedge members 48, 50 on the coupling device also extend at the same small acute angle relative to the bottom of the coupling frame. In this way, the wedge members on the coupling frame are able to slide smoothly and fully into the wedge-shaped channels that are formed between the wedge members 126, 128 and the horizontal legs 122 of the connecting rails. It will be understood that the wider front end 134 of the wedge-shaped channels is open in order to receive the wedge members of the coupling device. The other end of each channel can also be open as shown in FIG. 6 or it can be closed, if desired, provided the wedge members of the coupling device can be fully inserted into the channels.

In the preferred illustrated embodiment, each of the connecting members 36, 38 also forms an enclosed bar-receiving opening at 140 and it is into this opening that one of the locking bars, 86, 88 extends in the locking position. As illustrated in FIG. 7, these bar receiving openings are formed on one side of the tool or bucket 12. When the locking bars are inserted into the two openings 140, the locking bars prevent the coupling device from detaching from the tool or bucket. Preferably the side of each bar-receiving opening is adjustable by means of an adjustment bolt 142. By making the opening adjustable, this permits a snug engagement at all times between the front side of the locking bar and the top of the bolt 142, this top forming one side of the opening 140. Each bolt 142 is threaded into a threaded opening formed in a rigidly connected, supporting end block 146. This end block 146 can be welded to the adjacent angle member and in one version has a thickness of 2 inches. In order to secure the bolt in the desired position, a locking nut 148 is threaded onto the bolt and, when the bolt is in the desired position, this nut is threaded tight against the side 150 of the block 146.

Figure 12:
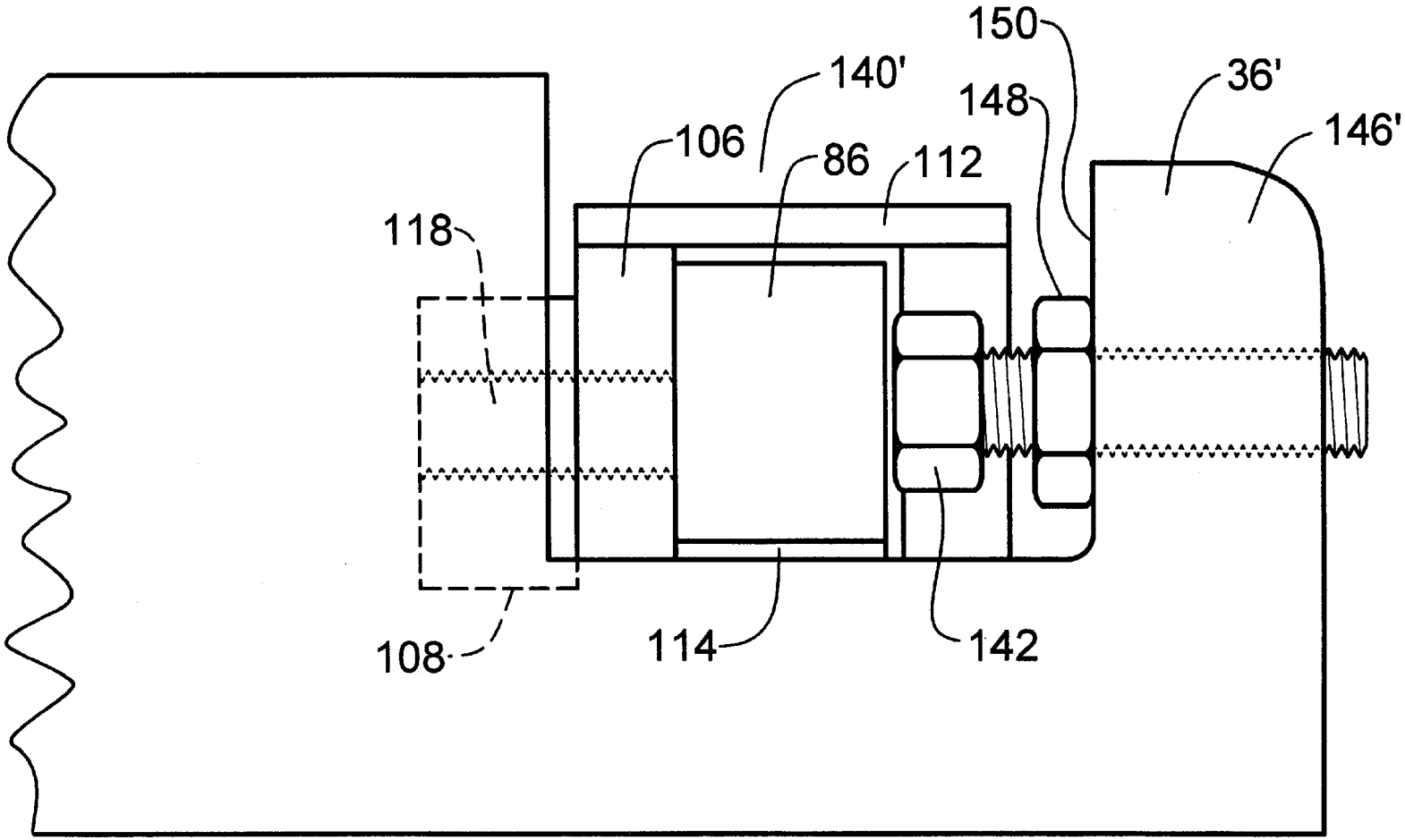
FIG. 12 is another detail elevation which shows the adjusting bolt in an alternate version of the end section of the mounting rail in which the bolt is mounted.

FIGS. 1 and 12 illustrates an alternate version of the connecting members that can be attached to the top of the tool such as a bucket. This version is indicated generally by reference number 36'. This version is constructed generally the same as the above described connecting members 36 and 38 except for the differences noted hereinafter. In this version, the bar receiving opening 140' has an open top and there is no horizontal top bar 200 as in the first embodiment shown in detail in FIG. 8. Also in this version the end support or end block 146' can be an integral extension of the rail member. The end block 146' is also formed with a threaded opening to receive the adjustment bolt 142.

Figure 13:
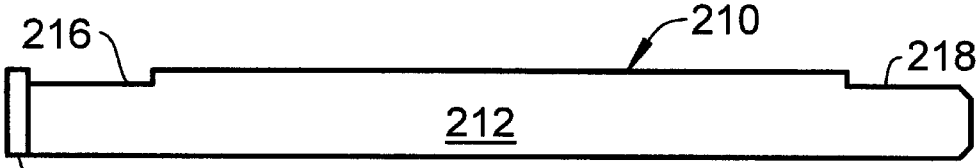
FIG. 13 is a plan view of a manual lock bar that can be used with the present coupling device.
Figure 14:
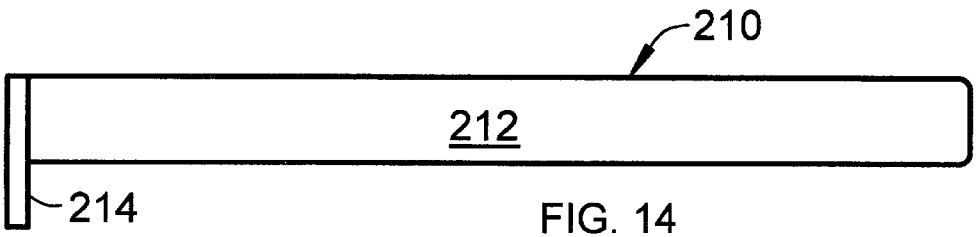
FIG. 14 is a side elevation of the lock bar of FIG. 13.

FIGS. 13 and 14 illustrate an optional manual lock bar that can be used in the event of a failure of the fluid actuator 84. With the use of this manual lock bar 210, it is possible to maintain a secure and reliable connection between the coupling device of the invention and the bucket so that the backhoe can continue to be used. It will be understood that in order to use this lock bar 210, the operator would detach the fluid actuator 84 from the coupling device together with the two locking bars 86,88 that are operated by the hydraulic actuator. The removal of these components will allow the lock bar 210 to be installed manually by the operator. The lock bar in one preferred embodiment comprises an elongate steel bar 212 with an end plate 214 welded thereto. The end plate projects downwardly from one end of the bar 212. In one embodiment the end plate has a vertical height of 4 inches and a width of 2 inches. In the same embodiment, the steel bar 212 has a length of 22½ inches and is 2 inches square for most of its length. End sections of the steel bar can be milled on one side to form shallow end recesses 216,218 which can, for example, be ¼ inch deep.

Figure 8:
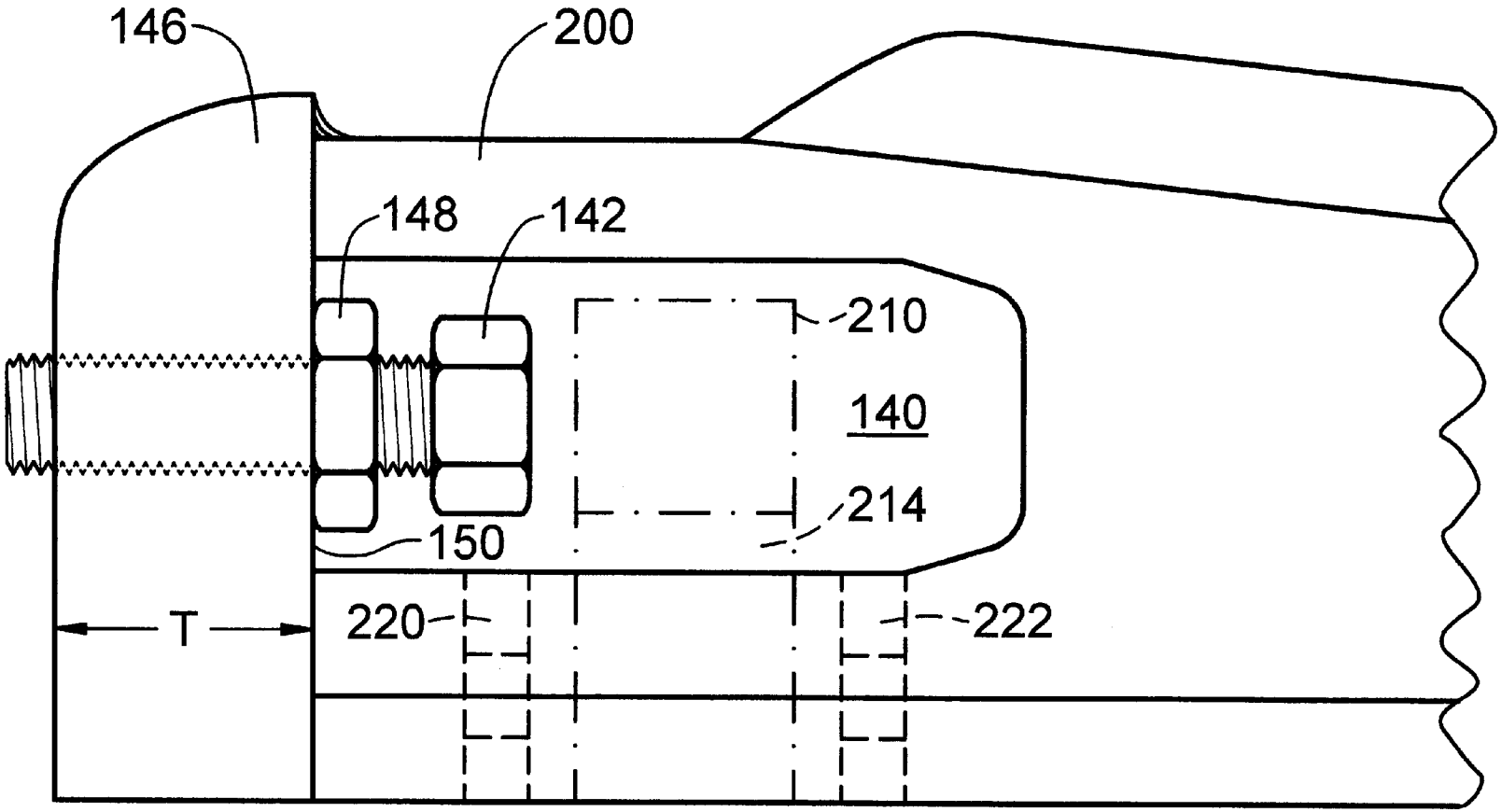
FIG. 8 is a detail elevation which shows an adjusting bolt and an end section of the preferred mounting rail in which the bolt is mounted.

The position of the manual lock bar 210 when it is being used is illustrated in chain lines in FIG. 8. From the outside of one of the connecting members or rails, the lock bar is inserted through each of the two openings 140. It will be understood that the bolt 142 is adjusted with respect to its position to engage the adjacent side of the lock bar. The end plate 214 rests against the outside of one of the connecting members and it is held in this position by a bolt that extends through two outwardly projecting lugs 220,222 in which the bolt is held by a suitable nut. It will be understood that the end plate 214 is trapped between the side of the bolt (not shown) and the side of the connecting member or rail.

Figure 15:
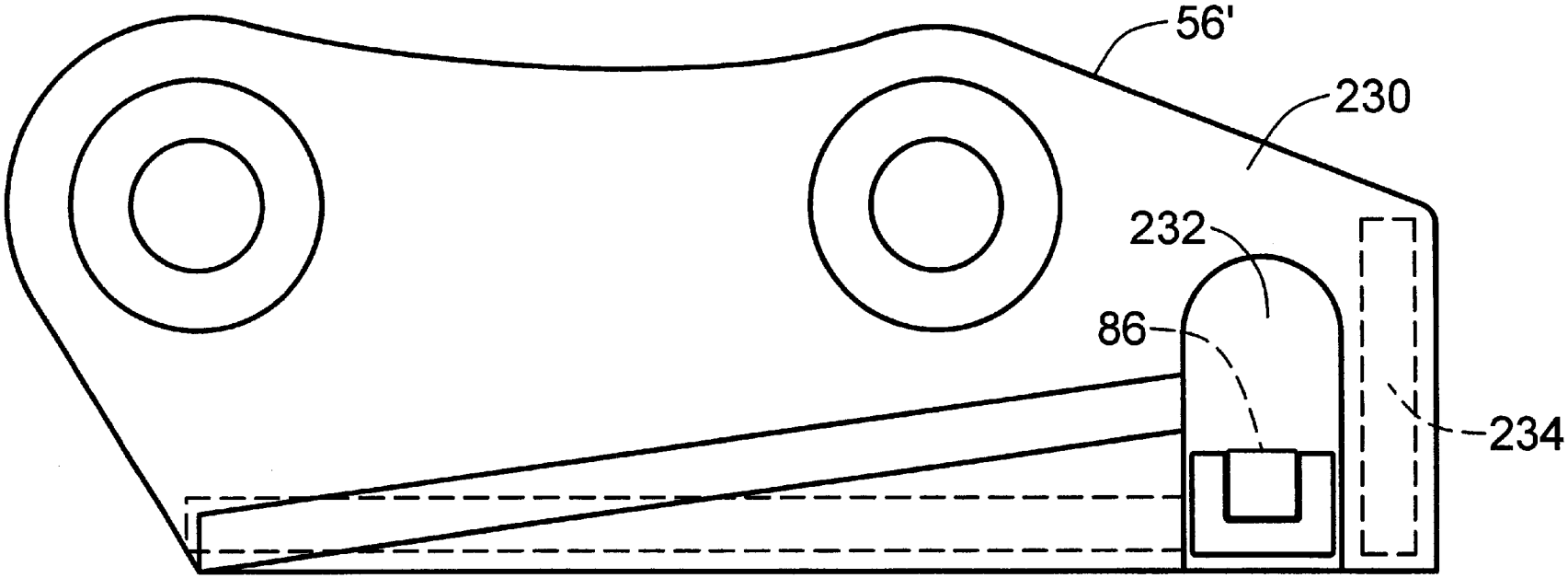
FIG. 15 is a side elevation showing an alternate form of side frame or connecting plate for the coupling device.

FIG. 15 illustrates an alternate form of side frame or connecting plate 56'. As in the first version illustrated in FIGS. 1 to 3, there are two of these parallel connecting plates. These plates are similar in their construction to the plates 56,58 illustrated in FIGS. 1 to 3 except as described differently herein. The connecting plate 56' has a forward extension at 230 which forms an opening 232. It will be understood that the two locking bars 86,88 project through the openings 232 at least in their locked position. The opening 232 can have a rounded top end as shown. In one embodiment, the width of the opening 232 is 3¾ inches its height is about 7½ inches. A short distance forwardly of the openings 232 is a front connecting plate 324 that extends between and joins the connecting plate 56' with the other, parallel connecting plate.

It will be understood by those skilled in the art that the hydraulic cylinder used in the present coupling device is connected by means of hydraulic hoses (not shown) to a hydraulic pump and a source of hydraulic fluid. The hoses can be connected on the inner side of the hydraulic cylinder, that is, the side facing towards the connecting frame member 60, in order to protect the hose connections. With this coupling device, the operator of the machine has the capability of disconnecting the bucket or other implement from a remote location, such as from the operator's seat of the backhoe. Also, it is possible to detach the coupling device by moving the locking bars 86, 86 inwardly to the unlocked position and then withdrawing the coupling device from the wedge-shaped channels without significant manual labor being required or without the use of manual tools.

It will be apparent to one skilled in this art that various modifications and changes can be made to the coupling device and the combination of a tool attachment and the coupling device of this invention as described herein without departing from the spirit and scope of this invention. Accordingly, all such modifications and changes as fall within the scope of the accompanying claims are intended to be part of this invention.

I claim:

1. A coupler device for releasably connecting a boom arm to a tool, such as a material handling bucket, said coupling device comprising:

a coupling frame adapted for connection to said boom and having wedge members provided on opposite, vertically extending sides thereof, and projecting outwardly and in a transverse direction from said vertically extending sides, said wedge members being adapted to engage in channels formed by connecting members mounted on said tool; and a fluid actuated locking mechanism for securing said wedge members in said channels, said locking mechanism being mounted on said coupling frame and including a fluid actuator, at least one locking bar movable by said fluid actuator between a locking position and an unlocked position, and a track for guiding movement of said at least one locking bar which is slidable along said track between said locking position and said unlocked position, wherein said track is rigidly connected to said coupling frame, and during use of said coupling device, in said locking position said at least one locking bar extends into a cooperating opening provided on said tool and thereby prevents said coupling device from detaching from said tool.

2. A coupling device according to claim 1 wherein said coupling frame comprises two, parallel connecting plates forming opposite sides of said coupling frame and rigid connecting frame members extending between and joining said connecting plates, said connecting plates both having pin receiving apertures for pivotably connecting the coupling device to said boom arm by means of connecting pins.

3. A coupling device according to claim 2 wherein said fluid actuator includes a double acting hydraulic cylinder having two piston rods extending from two opposite ends of said cylinder.

4. A coupling device according to claim 3 wherein said locking mechanism has two locking bars each of which is slidable in said transverse direction between said locking position and said unlocked position.

5. A coupling device according to claim 4 wherein said wedge members are each elongate metal bars that are welded to outer surfaces of said connecting plates and each metal bar extends substantially in a lengthwise direction relative to its respective connecting plate and at a small acute angle to a bottom of the coupling frame.

6. A coupling device according to claim 4 wherein each locking bar has a connecting lug extending perpendicularly from one side thereof and said connecting lug is detachably connected to an outer end of a respective one of the piston rods.

7. A combination of a tool attachment and a coupling device for releasably coupling said tool attachment to a boom arm, said tool attachment including two spaced-apart connecting members arranged on a side of the tool attachment, each of said connecting members forming a wedge-shaped channel which is open at one end thereof, and said coupling device comprising:

a coupling frame adapted for connection to said boom arm and having wedging devices provided on opposite sides thereof, each wedging device being adapted to slide into a respective one of the wedge-shaped channels by means of the open end of the channel and to engage a respective one of the connecting members; and a locking mechanism for securing the wedging devices in the wedge-shaped channels, said locking mechanism including a fluid actuator and at least one locking bar movable by said fluid actuator between a locking position and an unlocked position, wherein, when said coupling device is attached to said tool attachment, said at least one locking bar extends into a bar-receiving opening formed on said side of the tool attachment and thereby prevents said coupling device from detaching from said tool attachment.

8. A combination according to claim 7 wherein said connecting members are parallel metal rail members and each wedge-shaped channel is formed on an inner side of its respective rail member so that the two wedge-shaped channels face one another.

9. A combination according to claim 7 wherein the size of the bar-receiving opening is adjustable so as to permit a snug engagement between one side of the at least one locking bar and an adjacent adjustable side of said opening.

10. A combination according to claim 9 wherein the bar-receiving opening is formed in one end of at least one of the connecting members and one side of the bar-receiving opening is formed by an adjustable bolt.

11. A combination according to claim 9 wherein said locking mechanism has two locking bars each of which is slidable in a track mounted on said coupling frame between said locking position and said unlocked position, and wherein there are two bar-receiving openings formed by bar-receiving members provided on said side of the tool attachment.

12. A combination according to claim 8 wherein said tool attachment is a back hoe bucket and said metal rail members are welded to said side of said tool attachment so as to extend parallel to each other.

13. A combination according to claim 12 wherein said locking mechanism includes two locking bars and said fluid actuator is a double acting hydraulic cylinder having two piston rods extending from opposite ends of the cylinder.

14. A coupling device for releasably connecting a movable arm to a tool, said coupling device comprising:

a coupling frame pivotably attachable to said movable arm, said coupling frame including a pair of spaced-apart mounting plates each having a pair of pin-receiving holes with the holes of one mounting plate being aligned with the corresponding holes of the other mounting plate;

two wedge members rigidly mounted on outer surfaces of said mounting plates with each of the wedge members mounted on a respective one of said mounting plates and projecting from a side thereof furthest from the other mounting plate, said wedge members being adapted for insertion in connecting channels provided on a side of said tool;

a locking mechanism for securing said wedge members in said channels, said locking mechanism including a fluid operated actuator attached to said coupling frame and at least one locking member slidable along a guide provided on said coupling frame between a locking position and an unlocked position, wherein, during use of the coupling device, said at least one locking member can be extended into a cooperating opening provided on said tool by said fluid operated actuator in order to prevent said coupling device from separating from said tool.

15. A coupling device according to claim 14 wherein said fluid operated actuator is a double acting hydraulic cylinder that extends transversely relative to said coupling frame and that has two piston rods extending from opposite ends of the hydraulic cylinder.

16. A locking device according to claim 15 wherein there are two locking members and each locking member is connected to a respective one of said piston rods.

17. A locking device according to claim 14 including two metal, connecting rail members, each of said rail members forming one of said connecting channels when the rail member is mounted to said side of said tool, wherein said connecting channels are elongate and wedge-shaped.

18. A locking device according to claim 17 wherein there are two locking members and two cooperating openings and each rail member is adapted to form one of said cooperating openings adjacent one end thereof.

19. A locking device according to claim 18 wherein the size of each cooperating opening can be adjusted by means of a threaded adjustment bolt mounted in the respective rail member.

20. A coupler device for releasably connecting a boom arm to a tool, such as a material handling bucket, said coupling device comprising:

a coupling frame having two parallel connecting plates forming opposite, vertically extending sides of said coupling frame and rigid connecting frame members extending between and joining said connecting plates, said connecting plates both having pin receiving apertures for pivotably connecting the coupling device to said boom arm by means of connecting pins, said coupling frame being adapted for connection to said boom arm and having wedge members provided on said vertically extending sides thereof, and projecting outwardly and in a transverse direction from said vertically extending sides, said wedge members being adapted to engage in channels formed by connecting members mounted on said tool; and a fluid actuated locking mechanism for securing said wedge members in said channels, said locking mechanism being mounted on said coupling frame and including a fluid actuator comprising a double acting hydraulic cylinder having two piston rods extending from two opposite ends of said cylinder and two locking bars each of which is slidable in said transverse direction by said fluid actuator between a locking position and an unlocked position, wherein each of said two locking bars has a connecting lug extending perpendicularly from one side thereof and said connecting lug is detachably connected to an outer end of a respective one of the piston rods, and during use of said coupling device, in said locking position each of said two locking bars extends onto its own cooperating opening provided on said tool and thereby prevents said coupling device from detaching from said tool.

* * * * *